US011708971B2

(12) United States Patent
Cavalli

(10) Patent No.: US 11,708,971 B2
(45) Date of Patent: Jul. 25, 2023

(54) SIGNALLING DEVICE FOR EXTINGUISHERS AND/OR HYDRANTS

(71) Applicant: Axet S.r.l., Casale Sul Sile (IT)

(72) Inventor: Manuele Cavalli, Casale Sul Sile (IT)

(73) Assignee: AXET S.R.L., Casale Sul Sile (IT)

( * ) Notice: Subject to any disclaimer, the term of this patent is extended or adjusted under 35 U.S.C. 154(b) by 0 days.

(21) Appl. No.: 17/594,660

(22) PCT Filed: May 3, 2019

(86) PCT No.: PCT/IB2019/053621
§ 371 (c)(1),
(2) Date: Oct. 25, 2021

(87) PCT Pub. No.: WO2020/225586
PCT Pub. Date: Nov. 12, 2020

(65) Prior Publication Data

US 2022/0196235 A1 Jun. 23, 2022

(51) Int. Cl.

| | |
|---|---|
| ***F21V 33/00*** | (2006.01) |
| ***A62C 13/76*** | (2006.01) |
| ***A62C 37/50*** | (2006.01) |
| ***F21Y 115/10*** | (2016.01) |

(52) U.S. Cl.
CPC ..... *F21V 33/0076* (2013.01); *A62C 13/76* (2013.01); *A62C 37/50* (2013.01); *F21Y 2115/10* (2016.08)

(58) Field of Classification Search
CPC . F21V 33/0064; F21V 33/0076; A62C 13/76; A62C 37/50
See application file for complete search history.

(56) References Cited

FOREIGN PATENT DOCUMENTS

| | | | |
|---|---|---|---|
| CN | 203090316 | U | 7/2013 |
| CN | 103463759 | A | 12/2013 |
| CN | 104338266 | A | 2/2015 |
| CN | 109219470 | A | 1/2019 |

(Continued)

OTHER PUBLICATIONS

Chinese Office Action issued for Chinese Patent Application No. 201980096041.6, dated Mar. 25, 2022 in 13 pages including English translation.

(Continued)

*Primary Examiner* — Thomas M Sember
(74) *Attorney, Agent, or Firm* — Knobbe, Martens, Olson & Bear, LLP

(57) ABSTRACT

Described is signalling device for extinguishers or hydrants, comprising a first valve body connected to a tank of liquid and/or powder product to be dispensed, a second valve body connected to a hose equipped with a nozzle for dispensing product and a handle for activating the dispensing of the product equipped with a control lever; inside the handle is housed a safety plug shaped in such a way as to keep the control lever in an inactive position. The plug has, at a relative end portion, a magnet, which activates a sensor present on an electronic card located inside the control lever, designed to detect the presence of the plug. Moreover, the plug is made of transparent plastic material and at least one LED is positioned on a base facing a lower portion of the plug, in such a way that the LED produces a luminous emission which spreads for the entire plug, thereby operating as a luminous wave guide.

8 Claims, 2 Drawing Sheets

(56) References Cited

FOREIGN PATENT DOCUMENTS

| | | | |
|---|---|---|---|
| IT | MI20 080 701 | A1 | 10/2009 |
| JP | H10-133605 | A | 5/1998 |
| JP | 2003-275334 | A | 9/2003 |
| KR | 20130014785 | A | 2/2013 |
| WO | WO 97/26944 | A1 | 7/1997 |
| WO | WO 2018/087788 | A1 | 5/2018 |

OTHER PUBLICATIONS

Italian Search Report issued for Italian Patent Application No. IT201800004613, dated Dec. 11, 2018 in 9 pages.
International Search Report issued for International Patent Application No. PCT/IB2019/053621, dated Jan. 24, 2020 in 12 pages.

SIGNALLING DEVICE FOR EXTINGUISHERS AND/OR HYDRANTS

CROSS-REFERENCE TO RELATED APPLICATIONS

This application is the U.S. National Phase under 35. U.S.C. § 371 of International Application PCT/IB2019/053621, filed May 3, 2019. The disclosures of the above described applications are hereby incorporated by reference in their entirety and made a part of this specification.

SUMMARY

This invention relates, in general, to a device for signalling an alarm and/or a hazard situation for extinguishers or hydrants; more in particular, the invention relates to a device designed to signal a fire detected and provide an indication of the part of the extinguisher or hydrant on which to act to carry out the relative activation.

The following types of extinguishers and hydrants are currently on the market:

- portable and trolley-mounted powder extinguishers pressurised at 14/15 bar using nitrogen;
- portable and trolley-mounted CO2 extinguishers pressurised at 65 bar;
- water portable extinguishers pressurised with nitrogen;
- fire hose hydrants UNI 25;
- hydrants UNI 45;
- hydrants UNI 70.

However, the types of extinguishers and hydrants currently available on the market have never developed technologically over time, apart from the extinguishing materials used, the dimensions and thicknesses of the cases, the technology of the valve units and of the relative accessories in the case of the extinguishers and the construction of the nozzles and of the hoses in the case of the hydraulic systems.

In particular, the use of a extinguisher or hydrant as an object for signalling a hazard situation has not until now been planned, since the above-mentioned extinguishers or hydrants are traditionally passive objects, which, if they are used by unskilled persons and/or in panic situations, can constitute elements of unnecessary complexity or danger.

Therefore, in the context of the above-mentioned requirements, the aim of the invention is to overcome the drawbacks of the prior at and, in particular, make a signalling device for extinguishers or hydrants which allows the extinguisher or hydrant to also constitute an object for signalling a fire detected and/or a hazard situation in general.

Another aim of the invention is to make a signalling device for extinguishers or hydrants which allows details of the portion and/or part to be provided on which to act for activating the extinguisher or hydrant.

A further aim of the invention is to make a signalling device for extinguishers or hydrants which is extremely compact and ergonomic, as well as convenient and simple to use.

These and other aims are achieved within the scope of the invention by a signalling device for extinguishers or hydrants according to appended claim 1; other detailed technical characteristics of the optical device according to the invention are disclosed in the following dependent claims.

BRIEF DESCRIPTION OF THE DRAWINGS

Further aims and advantages will become clearer from the following description relative to a preferred embodiment of the signalling device for extinguishers or hydrants, according to the invention, given by way of example and without limiting its scope, with reference to the accompanying drawings, in which.

DETAILED DESCRIPTION

Figure 1:
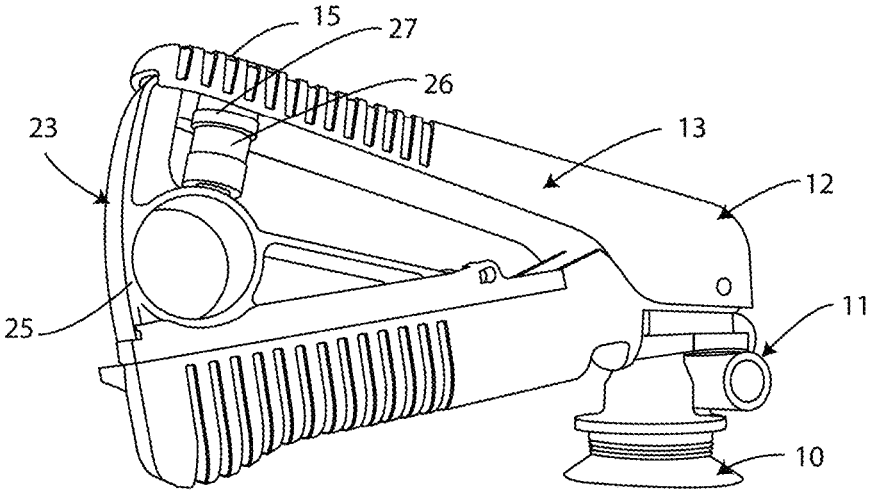
FIGS. 1 and 2 illustrate two respective perspective views of the signalling device according to the invention, housed inside a dispensing handle of an extinguisher or hydrant.
Figure 2:
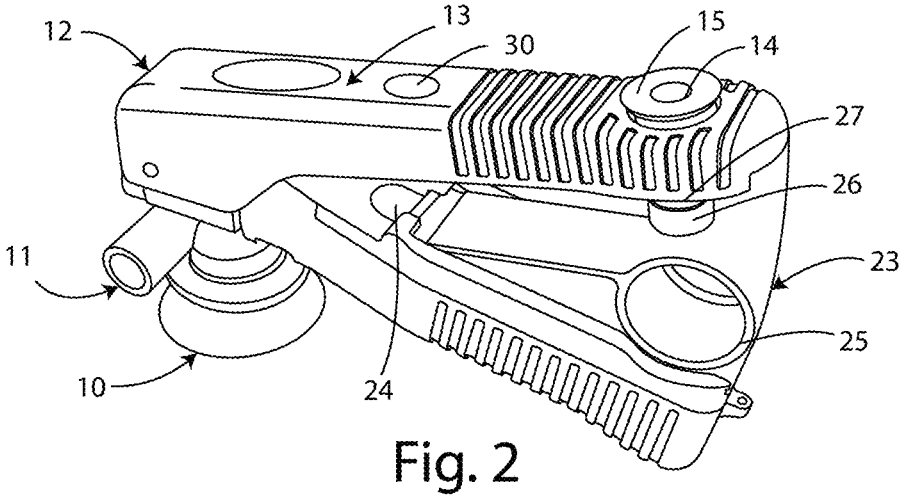
Figure 3:
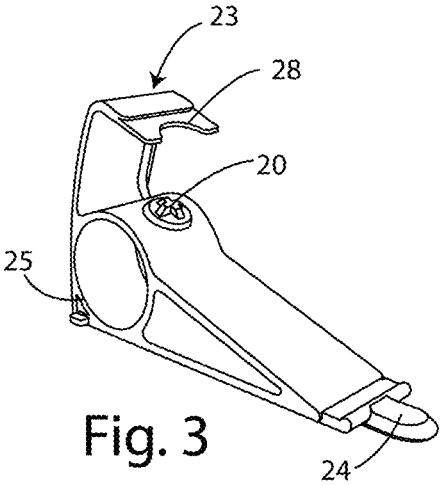
FIGS. 3 and 4 illustrate two respective perspective views of the signalling device for extinguishers or hydrants according to the invention.
Figure 4:
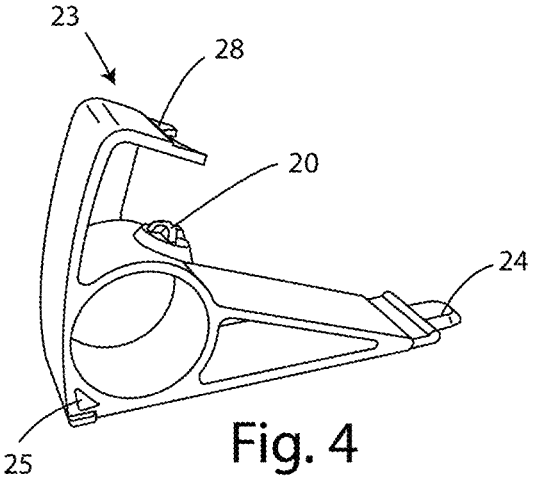
Figure 5:
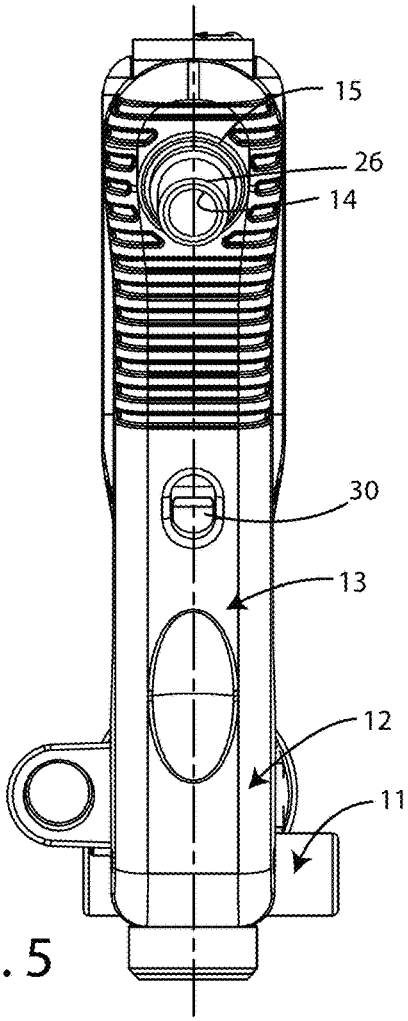
FIG. 5 illustrates a plan view from above of the dispensing handle of the extinguisher or hydrant of FIGS. 1 and 2 according to the invention.
Figure 6:
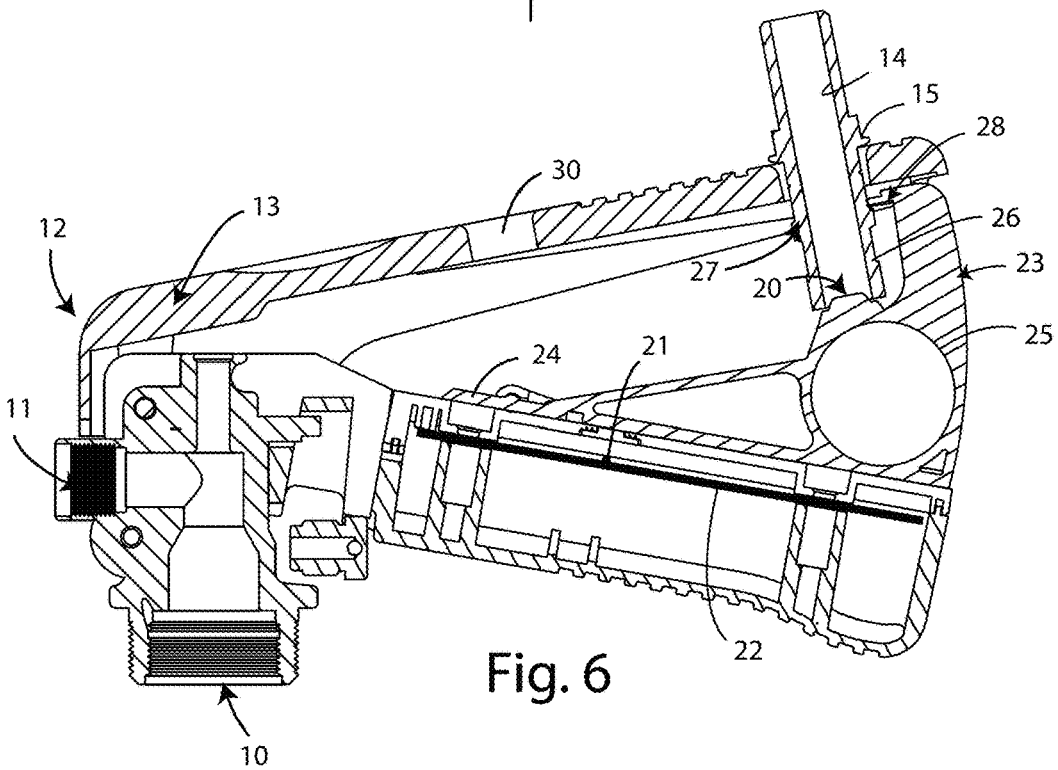
FIG. 6 illustrates a transversal cross section of the dispensing handle of FIGS. 1 and 2 according to the invention.

It should be noted that, even if the following description and the accompanying drawings refer explicitly to the use of a signalling device for extinguishers, the invention can be similarly applied and with the same principle to hydraulic systems, such as hydrants, water hoses, etc.

With reference to the above-mentioned drawings, reference numeral 10 indicates a first valve body connected to a tank (not illustrated) of liquid and/or powder product to be dispensed, reference numeral 11 indicates a second valve body connected to a hose equipped with a nozzle for dispensing product (not illustrated), whilst reference numeral 12 indicates a handle for activating the dispensing, equipped with a control lever 13. On the control lever 13 there is a hole or opening 14, which is usually designed to constitute the housing seat of the nozzle of the hose.

According to a preferred embodiment of the invention, inside the hole or opening 14 made on the control lever 13 is inserted a cover element 15, such as a cap, designed to act at simultaneously as a housing seat for the nozzle of the hose of the extinguisher and as protection for the above-mentioned nozzle from external agents, such as dust, corrosive or polluting substances, spiders webs, insect nests (such as bees), etc., which could cover the hole 14, with the consequence of damaging and/or causing malfunctions in the dispensing of the liquid and/or the powder contained in the extinguisher.

The cover element 15 normally consists of a hollow cylinder, open at the top and designed to be inserted inside the hole or opening 14 of the control lever 13 until the upper opening is substantially coplanar with the hole 14.

The cover element 15 can preferably be made of polymeric material, such as polycarbonate (PC) and acrylonitrile butadiene styrene (ABS), and, as mentioned, has an appropriate shape for it to be housed inside the hole or opening 14 of the control lever 13; for this reason, the cover element 15 can advantageously have a thickening of the upper circular edge and a series of projections or knurls on the side surface.

In fact, the thickening of the upper edge allows it to make contact with the rim of the hole or opening 14, once the cover element 15 is inserted and the above-mentioned projections or knurls are designed to be inserted by pressure and thereby keep the element 15 in its seat, inside the hole 14, avoiding its escape outside this location during the insertion and removal of the nozzle of the hose.

Moreover, the solution allows the nozzle to be constrained to the opportune housing seat, avoiding the provision of alternative couplings of the hose and of the relative nozzle to the tank of the extinguisher.

According to the invention, inside the handle 12 is housed a safety plug 23 shaped in such a way as to keep blocked in an inactive position the control lever 13; in that position, the shaped protrusion 20 of the plug 23 also blocks the nozzle of the hose inside the cover element 15, thereby also consequently blocking the hose.

The plug 23 has, at a relative elongate end portion, a magnet 24, which activates a sensor 30 present on an electronic card located inside the control lever 13.

This particular arrangement allows, by means of a single sensor 30, the simultaneous and objective verification of the positioning and of the correct operational status of the three different elements:

1) the presence of the hose, which is fixed, by means of the relative nozzle, to the inside of the housing seat provided in the cover element 15;

2) the closing status of the nozzle, since it is correctly inserted in the above-mentioned housing seat of the cover element 15 and covered by the protrusion 20 of the safety plug 23;

3) the correct insertion of the safety plug 23, which blocks the control lever 13 in a condition of the extinguisher which is closed and at rest and avoids accidental activation.

The use of the plug 23 prevents the possibility of the hose being removed, avoids it being accidentally or voluntarily extracted and left hanging along the walls of the tank (which would render useless the cover element 15 for protecting the nozzle of the hose) and, lastly, signals the correct positioning and/or any voluntary and/or accidental extraction of the plug 23 (which allows the control lever 13 to be used).

Moreover, the sensor 30 can be provided and used if the extinguisher or hydrant uses a remote control system, obtained with the electronic card applied to the above-mentioned extinguisher or hydrant.

In particular, as illustrated in the accompanying drawings, which show the detail of a possible means of implementation of the solution described above, the safety plug 23 is the blocking component, inserted inside the activation handle 12 of the extinguisher; the plug 23 can be extracted by an operator by acting on the ring 25 and extracting it from its seat.

When the hose is in position inside the housing seat of the cover element 15, the end part 26 of the nozzle is in contact with the protrusion 20 made on the ring 25 of the plug 23, whilst the side wall 27 of the nozzle is in contact with the upper shaped wing 28 of the plug 23, which, in the form of a fork, blocks the nozzle in the seat provided, acting on the connecting edge between the hose and the nozzle.

Moreover, the safety plug 23, inserted in this way in the activation handle 12 of the extinguisher moves the magnet 24 close to the sensor 30 located on the electronic card of the above-mentioned remote control system, as well as blocking the control lever 13.

The magnet 24 positioned in this way informs the electronic card of the insertion and of the presence of the safety plug 23.

When the plug 23 is extracted, the sensor 30 no longer feels the presence of the magnet 24 and therefore detects the extraction of the above-mentioned plug 23 and the activation of the extinguisher, giving the command for a remote alarm signal. According to a further important aspect of the invention, the extractable plug 23 is made of transparent plastic material and at least one LED 21 is positioned on a base 22 facing the lower portion of the plug 23, in such a way that the luminous emission of the LED 21 spreads for the entire plug 23, thereby operating as a luminous wave guide.

In this way, the extinguisher or hydrant also becomes, by means of the plug 23, an object for signalling a hazard situation for an entire building (fire detected, general alarm, etc.) and the illumination of the plug 23 by the LED 21 (which occurs in the case of an emergency) also indicates the part (control lever) on which to act to activate the extinguisher or hydrant. This enables the plug 23 to be used as an active element for identifying and signalling the extinguisher and as an alarm device in the case of an emergency, which is particularly useful especially in panic situations and/or if the extinguisher or hydrant is used by unskilled persons.

The characteristics of the signalling device for extinguishers and hydrants, object of the present invention, clearly emerge from the description, as do the advantages thereof.

Lastly, it is clear that numerous variants might be made to the signalling device in question, without forsaking the principles of novelty of the inventive idea, while it is clear that in the practical actuation of the invention, the materials, the shapes and the dimensions of the illustrated details can be of any type according to requirements, and can be replaced by other technically equivalent elements.

What is claimed is:

1. A signalling device for extinguishers or hydrants, comprising:

a first valve body connected to a tank at least one of liquid and powder product to be dispensed, a second valve body connected to a hose equipped with a nozzle for dispensing product, and a handle for activating the dispensing of said product equipped with a control lever, wherein, inside said handle, is housed a safety plug shaped in such a way as to keep said control lever in an inactive position, said plug having, at a relative end portion, a magnet, which activates a sensor present on an electronic card located inside said control lever, configured to detect the presence of said safety plug, and wherein said plug comprises transparent plastic material, and at least one LED is positioned on a base facing a lower portion of said plug, in such a way that said LED produces a luminous emission which spreads for the entire plug, said plug thereby operating as a luminous wave guide.

2. The signalling device according to claim 1, wherein said plug is illuminated by said LED in the case of an emergency, in such a way that said extinguisher or hydrant becomes an object for signalling a hazard situation and that said plug constitutes an indication of a part on which to act to activate said extinguisher or hydrant.

3. The signalling device according to claim 1, wherein said control lever has an opening where said nozzle of the hose is inserted and that said plug has a shaped protrusion, configured to block said nozzle inside a cover element inserted in said opening.

4. The signalling device according to claim 1, wherein said shaped protrusion is made on a portion of a shaped ring of said plug, said shaped ring being usable to extract said plug from the inside of said handle.

5. The signalling device according to claim 1, wherein said nozzle is in contact with a shaped wing of the plug, which blocks said nozzle in a predetermined position.

6. The signalling device according to claim 1, wherein inside said opening made on the control lever is inserted a cover element as a housing seat for said nozzle of the hose of the extinguisher and as protection for said nozzle from external agents.

7. A signalling device according to claim 6, wherein said cover element consists of a hollow cylinder, open at the top and configured to be inserted inside the opening of the control lever.

8. The signalling device according to claim 6, wherein said cover element has a thickening of an upper circular edge and a series of projections or knurls on a side surface.

* * * * *